US010041656B2

(12) United States Patent
McCoy

(10) Patent No.: US 10,041,656 B2
(45) Date of Patent: Aug. 7, 2018

(54) HUE-MODIFYING WRAP FOR A LIGHT BULB

(71) Applicant: XMARK HOLDING LLC, Nampa, ID (US)

(72) Inventor: Daniel L. McCoy, Nampa, ID (US)

(73) Assignee: Xmark Holding LLC, Nampa, ID (US)

( * ) Notice: Subject to any disclaimer, the term of this patent is extended or adjusted under 35 U.S.C. 154(b) by 34 days.

(21) Appl. No.: 15/186,017

(22) Filed: Jun. 17, 2016

(65) Prior Publication Data

US 2016/0369974 A1 Dec. 22, 2016

Related U.S. Application Data

(60) Provisional application No. 62/181,020, filed on Jun. 17, 2015.

(51) Int. Cl.

| | |
|---|---|
| ***F21V 14/00*** | (2018.01) |
| ***F21V 17/10*** | (2006.01) |
| ***F21V 9/08*** | (2018.01) |
| ***F21K 9/232*** | (2016.01) |

(52) U.S. Cl.

CPC ..... *F21V 17/101* (2013.01); *F21K 9/232* (2016.08); *F21V 9/08* (2013.01)

(58) Field of Classification Search

CPC ..... F21V 17/04; F21V 17/101; F21K 9/232
USPC ..... 362/255
See application file for complete search history.

(56) References Cited

U.S. PATENT DOCUMENTS

| | | | | |
|---|---|---|---|---|
| 1,259,505 | A | 3/1918 | Franche | |
| 5,637,265 | A | 6/1997 | Misciagno et al. | |
| 8,047,689 | B2 | 11/2011 | Blalock | |
| 8,242,667 | B2 | 8/2012 | Gruber | |
| 8,915,623 | B1 | 12/2014 | Claudet | |
| 9,157,624 | B2 | 10/2015 | Nourbakhsh et al. | |
| 9,163,819 | B2 | 10/2015 | Dassanayake et al. | |
| 9,222,640 | B2 | 12/2015 | Sun et al. | |
| 2010/0002451 | A1 | 1/2010 | Reynolds | |
| 2010/0265726 | A1 | 10/2010 | Blalock | |
| 2012/0243235 | A1* | 9/2012 | Gao | F21V 3/00 362/294 |
| 2013/0094180 | A1 | 4/2013 | Sun et al. | |
| 2014/0043808 | A1 | 2/2014 | Dassanayake et al. | |

(Continued)

FOREIGN PATENT DOCUMENTS

WO 1997041180 11/1997

OTHER PUBLICATIONS

Lightopia blog article by Michael. Egg-bot Art Robot: Light Bulb Printing. Feb. 2, 2013. URL: http://blog.lightopiaonline.com/lighting-videos/egg-bot-making-the-impossible-possible (4 pages).

(Continued)

*Primary Examiner* — Ahshik Kim
(74) *Attorney, Agent, or Firm* — Colby Nipper

(57) ABSTRACT

A hue-modifying wrap for a light bulb comprising at least one lamp and at least one hue-modifying light bulb wrap, the hue-modifying light bulb wrap comprising at least one hue-modifying portion for modifying the hue emitted from the lamp, the hue-modifying light bulb wrap able to be transformed between a first, expanded configuration and second, contracted configuration about at least a portion of light bulb, altering the hue of light emitted therefrom.

24 Claims, 6 Drawing Sheets

(56) References Cited

U.S. PATENT DOCUMENTS

| | | | | |
|---|---|---|---|---|
| 2014/0043832 | A1* | 2/2014 | Ruriani | H01J 61/327 362/372 |
| 2014/0092603 | A1* | 4/2014 | Chen | F21V 23/0442 362/294 |
| 2015/0276165 | A1* | 10/2015 | Rhelyii | F21V 29/70 362/373 |

OTHER PUBLICATIONS

Images of printed light bulbs. light-bulbs-big.gif (406×480). Retrieved from the intemet on Feb. 19, 2016. URL: http://www.inkcups.com/uploads/images/blog/pad-printing/light-bulbs-big.gif (1 page).

Inkcups Now Blog by Stephen. 41 Cool things yu Can Do With Pad Printing. Feb. 11, 2010. URL: http://www.inkcups.com/blog/pad-printing/41-things-cool-things-about-pad-printing (9 pages).

* cited by examiner

HUE-MODIFYING WRAP FOR A LIGHT BULB

PRIORITY/CROSS-REFERENCE TO RELATED APPLICATIONS

This application claims the benefit of U.S. Provisional Application No. 62/181,020, filed 17 Jun. 2015, the disclosure of which is incorporated by reference.

TECHNICAL FIELD

The disclosure generally relates to the field of lighting. Particular embodiments relate to hue-modifying wraps for light bulbs.

BACKGROUND

Theater and movie production industries oftentimes use color media to color light produced by a lamp. In one example of such a use, color media is inserted into a holder directly in front of the lamp so as to color the light produced by the lamp. Color media comes in many forms, including glass media, colored sheets (e.g., gelatin, polyethylene, polycarbonate), and dichroic filters.

With the development and proliferation of LED and florescent light bulbs for the residential market, the largest consumer complaint with such bulbs is that they give off a cool blue or green hue. For LED lighting this is compounded by the fact that LED have a very narrow band of visible light when compared with traditional incandescent lighting.

SUMMARY OF THE DISCLOSURE

Several exemplary hue-modifying wraps for light bulbs are described herein.

A first exemplary hue-modifying wrap for a light bulb comprises a hue-modifying wrap with indicia printed thereon. The hue-modifying wrap is configured for transformation between a first, expanded configuration and second, contracted configuration. In its first, expanded configuration, the hue-modifying wrap is generally two-dimensional. In its second, contracted configuration, the hue-modifying wrap is adhered to the surface of a light bulb, preferably about a generally dome-shaped light, such as a LED.

The material comprises the hue-modifying wrap is preferably selected from the group consisting of polyvinyl, polyester, polyolefin, polyvinyl chloride (PVC), polyethylene, and polypropylene. Additionally, the hue-modifying wrap preferably comprises an adhesive side for application to the surface of the light bulb.

A second exemplary hue-modifying wrap for a light bulb comprises a first hue-modifying wrap and second hue-modifying wrap, each with indicia printed thereon. The first hue-modifying wrap and second hue-modifying wrap are configured for transformation between a first, expanded configuration and second, contracted configuration. In its first, expanded configuration, the first hue-modifying wrap and second hue-modifying wrap are generally two-dimensional. In its second, contracted configuration, the first hue-modifying wrap and second hue-modifying wrap are adhered to the surface of a light bulb, preferably with little-to-no overlap, the light bulb preferably being a generally conical-shaped light.

The material comprising the first hue-modifying wrap and second hue-modifying wrap is preferably selected from the group consisting of polyvinyl, polyester, polyolefin, polyvinyl chloride (PVC), polyethylene, and polypropylene. Additionally, the first hue-modifying wrap and second hue-modifying wrap preferably comprise an adhesive side for application to the surface of the light bulb.

DETAILED DESCRIPTION

Figure 2:
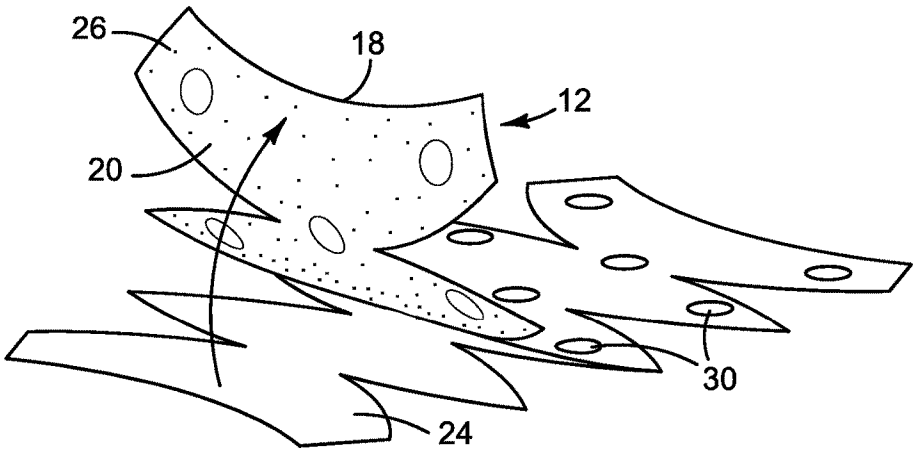
FIG. 2 is a top side perspective view of the first exemplary hue-modifying wrap illustrating the wrap being removed from its backing portion.

The following description and the referenced drawings provide illustrative examples of that which the inventor regards as his invention. As such, the embodiments discussed herein are merely exemplary in nature and are not intended to limit the scope of the invention, or its protection, in any manner. Rather, the description and illustration of these embodiments serve to enable a person of ordinary skill in the relevant art to practice the invention.

The use of "e.g.," "etc.," "for instance," "in example," "for example," and "or" and grammatically related terms indicates non-exclusive alternatives without limitation, unless the context clearly dictates otherwise.

The use of "including" and grammatically related terms means "including, but not limited to," unless the context clearly dictates otherwise.

The use of the articles "a," "an" and "the" are meant to be interpreted as referring to the singular as well as the plural, unless the context clearly dictates otherwise. Thus, for example, reference to "a polymer film" includes two or more such polymer films, and the like.

The use of "optionally," "alternatively," and grammatically related terms means that the subsequently described element, event or circumstance may or may not be present/occur, and that the description includes instances where said element, event or circumstance occurs and instances where it does not, unless the context clearly dictates otherwise.

The use of "preferred," "preferably," and grammatically related terms means that a specified element or technique is more acceptable than another, but not that such specified element or technique is a necessity, unless the context clearly dictates otherwise.

The use of "exemplary" means "an example of" and is not intended to convey a meaning of an ideal or preferred embodiment, unless the context clearly dictates otherwise.

The use of "hue" means "the color or tint of light emitted," unless the context clearly dictates otherwise.

The use of "hue-modifying" means "capable of modifying hue," unless the context clearly dictates otherwise.

The use of "wrap" means "a material applied about an object," unless the context clearly dictates otherwise. Examples of wraps include, but are not limited to, materials adhered, shrink-wrapped, or printed on or to a light bulb.

The use of "light bulb" means "a device that is capable of emitting electromagnetic radiation in the visible spectrum," unless the context clearly dictates otherwise. A light bulb will include one or more lamps. Examples of light bulbs include, but are not limited to, incandescent light bulbs, fluorescent light bulbs, high-intensity discharge (HID) light bulbs, compact fluorescent (CFL) light bulbs, and light emitting diode (LED) light bulbs.

The use of "lamp" means "the component of a light bulb that produces light from electricity," unless the context clearly dictates otherwise.

The use of "printed" means "any method of application, such as by painting, applying ink, printing, or the like," unless the context clearly dictates otherwise.

The use of "indicia" means "any colors, designs, patterns, or the like," unless the context clearly dictates otherwise.

The use of "adhesive" means "a substance used for mating two or more objects together," unless the context clearly dictates otherwise.

The use of "adhesive" means "a substance used for mating two or more objects together," unless the context clearly dictates otherwise.

The use of "polymer" means "a substance that has a molecular structure consisting chiefly or entirely of a large number of similar units bonded together," unless the context clearly dictates otherwise. Examples of polymers include but are not limited to polyvinyl, polyester, polyolefin, polyvinyl chloride (PVC), polyethylene, and polypropylene.

The use of "polyvinyl" means "materials or objects made from polymers of vinyl compounds," unless the context clearly dictates otherwise.

Disclosed is a plurality of exemplary systems for modifying the hue of light emitted from a light bulb. Each of the systems comprise at least one hue-modifying wrap for the light bulb. The hue-modifying wrap configured for covering at least a portion of the light bulb and modifying at least a portion of the light emitted from the light bulb.

FIGS. 1 through 5 illustrate a first exemplary system for modifying the hue of light emitted from a light bulb. The first exemplary system 10 comprises at least one hue-modifying wrap 12 for a light bulb 80.

The hue-modifying wrap 12 comprises at least one body portion 13 for covering at least a portion of the light bulb 80. At least a portion of the body portion 13 is configured for modifying the hue of light passing therethrough.

The first exemplary system 10 is configured such that the entire body portion 13 and plurality of projections 28 modify the hue of light passing therethrough, or only a portion of the body portion 13 and plurality of projections 28 modify the hue of light passing therethrough.

The body portion 13 is preferably comprised of a light-penetrable polymer, such as a polyvinyl. Although polyvinyl is the preferred polymer for the body portion of the hue-modifying wrap of the first exemplary system, a skilled artisan will be able to select an appropriate structure and material for the hue-modifying wrap in a particular embodiment based on various considerations, including the intended use of the hue-modifying wrap, the type of light bulb used with the hue-modifying wrap, and anticipated temperature of the outer surface of the light bulb, among other considerations. For instance, in other exemplary systems, a different polymer could be used, whereas in other exemplary systems, a non-polymeric body portion could be used. The body portion 13 is configured for transformation between a first, expanded configuration and second, contracted configuration.

The body portion 13 comprises a plurality of projections 28, each projection further comprises a side 29. The projections 28 enable the hue-modifying wrap 12 to be transformed from its first, expanded configuration to its second, contracted configuration. Specifically, the projections 28 are adhered to the surface of the light bulb, in various positions. The sides 29 are then brought together, preferably with minimal overlap, such that at least a portion of the light bulb 80 is covered. Though it is preferable that the sides 29 be minimally-overlapped, the sides 29 can be overlapped.

Figure 1:
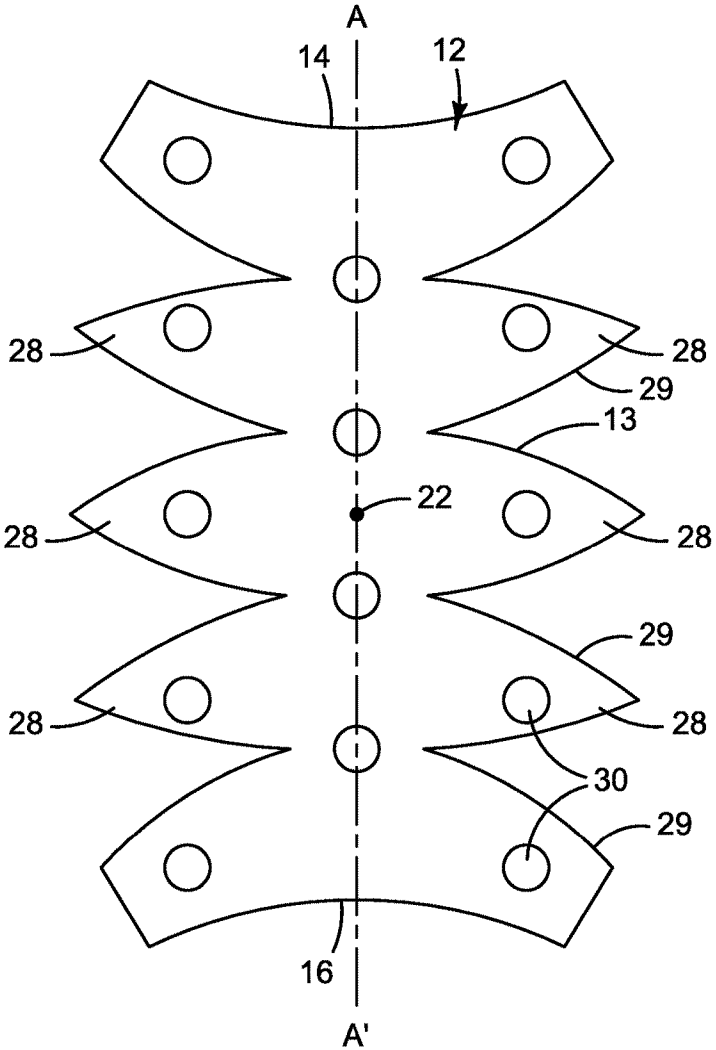
FIG. 1 is a top plan view of a first exemplary hue-modifying wrap.

In the first, expanded configuration illustrated in FIG. 1, the body portion 13 is, generally, two-dimensional. In this configuration, the body portion 13 is capable of transformation to its second, contracted configuration about a light bulb. When transformed to the second, contracted configuration (illustrated in FIG. 5 and discussed below) the plurality of projections 28 adhere to the surface of the light bulb, with minimal overlap of the adjacent sides 29, such that generally the entire surface of the light bulb 80 is covered by the body portion 13. Though it is preferable that the entire surface of the light bulb 80 be covered, the plurality of projections 28 can cover up to the entire surface of the light bulb 80.

FIG. 1 illustrates the first exemplary system 10. The hue-modifying wrap 12 illustrated in this Figure is of a generally "caterpillar-shaped" design and comprises a body portion 13 comprises a first end 14 extending to a second end 16 and a plurality of projections 28 therebetween. Specifically, each projection comprises a side 29 adjacent the preceding and/or subsequent projection 28. In this exemplary hue-modifying wrap 12, the plurality of projections 28 are generally symmetrical about line A-A' and extend generally perpendicularly from line A-A'.

Further, in the first exemplary system 10, the body portion 13 comprises one or more portions for modifying the hue of light passing therethrough. The body portion 13 can comprise multiple portions, where some of the portions differently modify the hue of light passing therethrough (in comparison with other portions), so as to achieve an overall hue modification for the light bulb.

As illustrated in FIG. 1, the body portion 13 comprises a base portion 45 which covers most of the body portion 13. The base portion 45 is preferably configured for modifying the hue of light passing therethrough. The body portion 13 also comprises at least one indicia portion 30 which is configured for modifying the hue of light passing therethrough. In the embodiment illustrated in FIG. 1, illustrated are a plurality of generally dot-shaped indicia portions 30.

The indicia portions 30 are preferably configured to modify the hue of light passing therethrough. The indicia portions 30 can all modify the hue of light passing therethrough, or only a portion thereof. All or a portion of the indicia portions 30 can be generally clear, thus modifying little to no hue of light passing therethrough. Further, one or more of the indicia portions 30 can be configured so as to make a light bulb covered with the hue-modifying wrap 12 more aesthetic in general. For example, the portion for modifying the hue of light passing therethrough can comprise a solid color, opaque color, designs, patterns, or the like.

Further, the body portion 13 comprises a first side 18 and second side 20. The second side 20 preferably comprises an adhesive portion 26, covered by a removable backing portion 24. The second side 20 configured for application to a light bulb 80. Preferably, the adhesive portion 26 is a generally-permanent adhesive. However, the second side does not, necessarily, have to comprise a generally-permanent adhesive and, alternatively, can comprise a more temporary adhesive.

While it is preferred that the second side comprise an adhesive, a skilled artisan will be able to select an appropriate manner of attaching the wrap to the light bulb in a particular embodiment based on various considerations, including the intended use of the light bulb, the intended arena within which the light bulb will be used, and the equipment and/or accessories with which the light bulb is intended to be used, among other considerations. For example, the wrap could comprise a shrinkable material that is shrunken onto the light bulb via heat or another process, the wrap could comprise a "static-cling" material that is applied to the light bulb, the wrap could be printed on the light bulb, etc.

Referring now to FIG. 2, this Figure illustrates the body portion 13 being removed from the backing portion 24, exposing the adhesive portion 26 on the body portion 13. The adhesive portion 26 can be, for example, a temporary adhesive, though it is preferable that the adhesive portion 26 be permanent such that the hue-modifying wrap 12 will remain adhered to the outer surface 96 of the light bulb 80. When removed from the backing portion 24, the body portion 13 is capable of being applied to the outer surface 96 of the light bulb 80, as illustrated in FIGS. 3 through 5.

Figure 4:
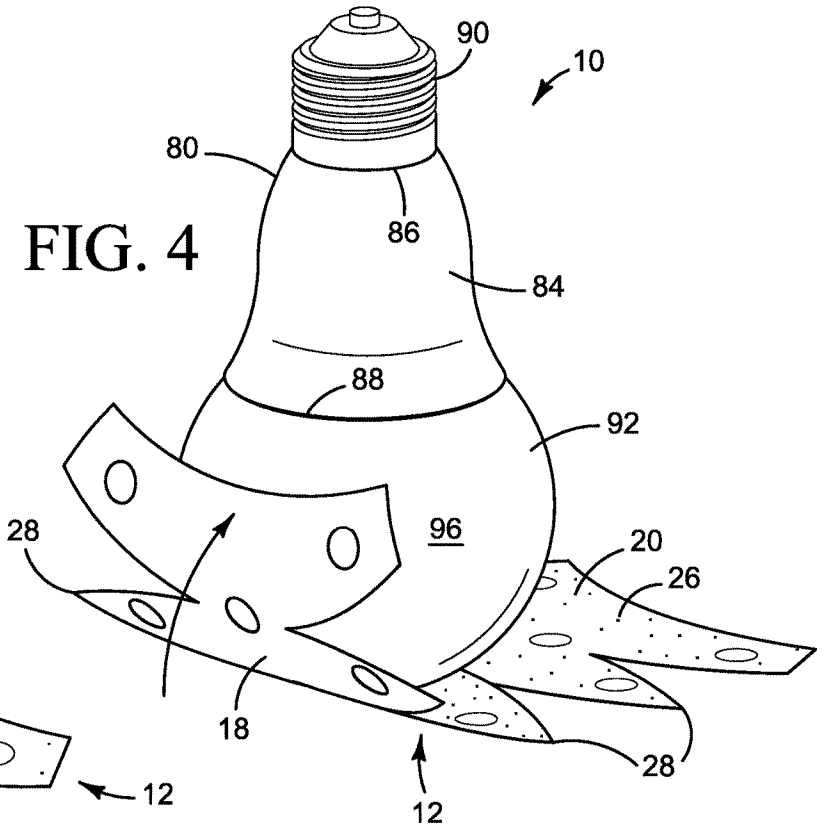
FIG. 4 is a second sequential top side perspective view of the first exemplary hue-modifying wrap illustrating the wrap being further applied to a light bulb.
Figure 3:
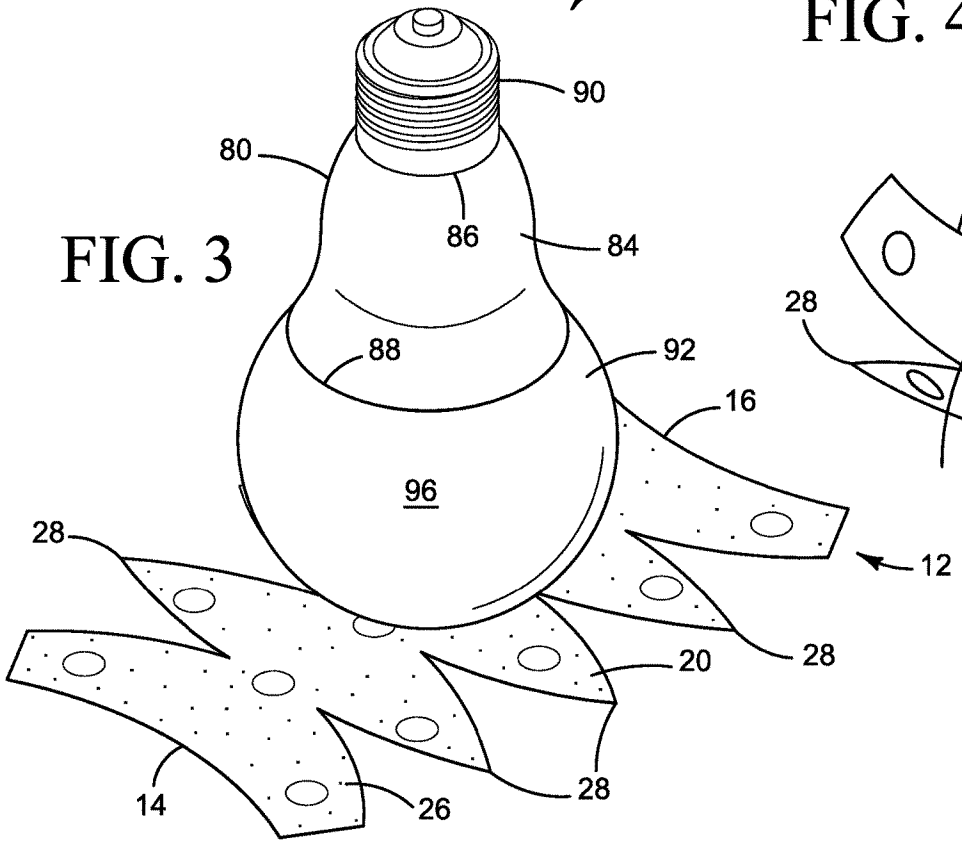
FIG. 3 is a first sequential top side perspective view of the first exemplary hue-modifying wrap illustrating the wrap being applied to a light bulb.
Figure 5:
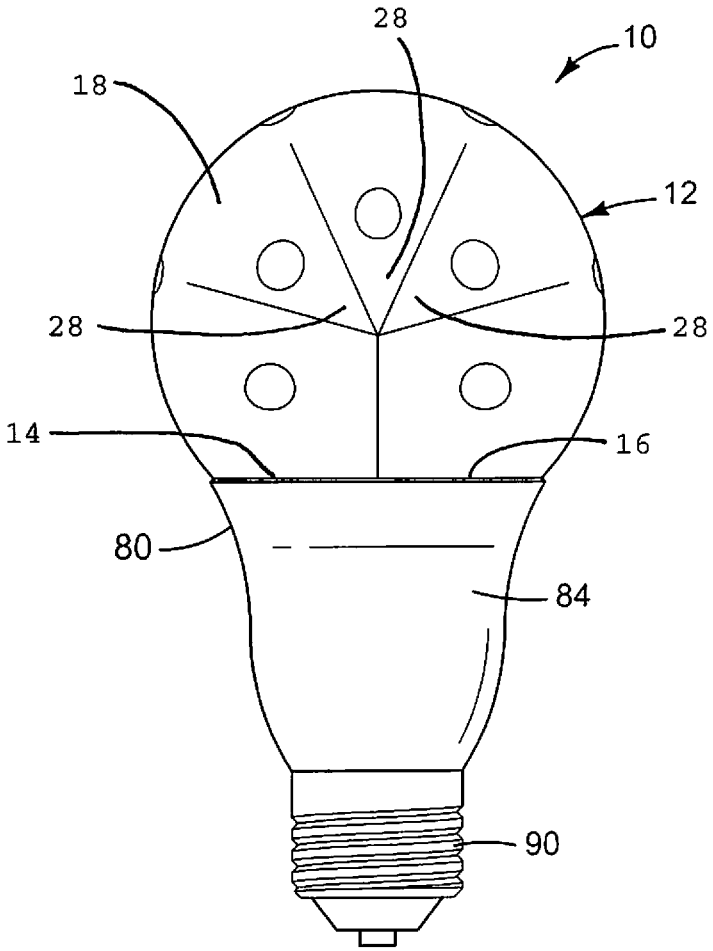
FIG. 5 is a side view of the first exemplary hue-modifying wrap illustrating the wrap applied to a light bulb.

FIGS. 3 through 5 illustrate the first exemplary system 10 being applied to a light bulb 80. The light bulb 80 illustrated is of the "A series" type (shape). While the light bulb 80 illustrated is of the "A series" type, a skilled artisan will be able to select an appropriate light bulb shape in a particular embodiment based on various considerations, including the intended use of the light bulb, and the intended type of the light bulb needed, among other considerations.

The light bulb 80 comprises at least one light source (not illustrated), at least one bulb portion 92 having an outer surface 96, and at least one socket connector 90 configured for coupling with a power source. The exemplary light bulb 80 illustrated further comprises a housing portion 84 for containing lighting components. The housing portion 84 comprising at least one light-penetrable surface. The housing portion 84 extends between the socket connector 90 and the bulb portion 92. The housing portion 84 comprises a first end 86 and second end 88, the first end 86 abutting the socket connector 90 and the second end 88 abutting the bulb portion 92. Preferably, the body portion 92 is light-penetrable. Preferably, the bulb portion 92 is generally dome-shaped, such as the bulb-shape illustrated in the Figures. The bulb portion 92 further comprises an inner surface (not illustrated). While this is preferred for this exemplary system, a skilled artisan will be able to select a proper light bulb configuration and shape suitable for application by the first exemplary system utilized in other exemplary systems.

One exemplary method of applying the first exemplary system 10 to a light bulb 80 can be described as follows. To apply the first exemplary system 10 to a light bulb 80, the backing portion 24 is removed from the second side 20 of the body portion 13 exposing the adhesive portion 26. The center point 22 of the second side 20 is then generally aligned, approximately, with the center point 98 of the body portion, adhering the center point 22 of the second side 20 to the center point 98 of the body portion. The hue-modifying wrap 12 is then transformed to its second, contracted configuration by stretching the first end 14 away from the center point 22, aligning the first end 14 and second end 16 with the second end 88.

Further, the second end 16, too, is stretched away from the center point 22, aligning the second end 16 with the socket connector 90. The plurality of projections 28 are then stretched about the bulb portion 92 of the light bulb 80, adhering each projection 28 thereto. It is preferable that, in this second, contracted configuration, little-to-no overlap exists between either the first end 14 and second end 16 or the plurality of projections 28. This description of an exemplary method of applying the first exemplary system 10 to a light bulb 80 is not intended to be all inclusive. A skilled artisan will be able to select an appropriate method for applying an exemplary hue-modifying wrap to a light bulb in a particular embodiment based on various considerations.

Any suitable structure and/or material can be used for the first exemplary system, and a skilled artisan will be able to select an appropriate structure and material for use in a particular embodiment based on various considerations, including the intended use of the hue-modifying wrap, the type of light bulb used with the hue-modifying wrap, and the equipment and/or accessories with which the hue-modifying wrap is intended to be used, among other considerations.

The material comprises the hue-modifying wrap is preferably a polymeric material. It is preferred that the polymeric material be selected from the group consisting of polyvinyl, polyester, polyolefin, polyvinyl chloride (PVC), polyethylene, and polypropylene. It is preferred that the polymeric material selected be able to withstand surface temperatures of the light bulb ranging from −40° F. to 186° F., without failing or deforming. However, a skilled artisan will be able to select an appropriate structure and material for the hue-modifying wrap in a particular embodiment based on various considerations, including the intended use of the wrap, the intended arena within which the wrap will be used, and the equipment and/or accessories with which the wrap is intended to be used, among other considerations.

Further, it is preferable that the exemplary polymeric material able to be stretched to a stretched length that is about one-hundred and twenty (120) percent of its relaxed length. While such a degree of stretchability is preferred, a skilled artisan may select a polymeric material having no stretchability, less stretchability or more stretchability than the preferred about one-hundred and twenty (120) percent in a particular embodiment based on various considerations, including the intended use of the hue-modifying wrap, the intended arena within which the hue-modifying wrap will be used, and the equipment and/or accessories with which the hue-modifying wrap is intended to be used, among other considerations.

By exhibiting such an elasticity rating, the first end 14 and second end 16 of the hue-modifying wrap 12, as well as the plurality of projections 28, are able to stretch and be adhered about the outer surface 96 of the light bulb 80 without excessive deformation of the colors, designs, and/or patterns printed thereon. However, a skilled artisan will be able to select an appropriate structure and material for the hue-modifying wrap in a particular embodiment based on various considerations, including the intended use of the wrap, the intended arena within which the wrap will be used, and the equipment and/or accessories with which the wrap is intended to be used, among other considerations.

Additionally, the presence of a plurality of projections 28 allows the hue-modifying wrap 12 to be stretched and applied equidistantly from its center point 22 about the light bulb 80. Again, by applying the hue-modifying wrap 12 in such a manner, any designs and/or patterns present on the hue-modifying wrap 12 are less-distorted. However, a skilled artisan will be able to select an appropriate structure and material for the hue-modifying wrap in a particular embodiment based on various considerations, including the intended use of the wrap, the intended arena within which the wrap will be used, and the equipment and/or accessories with which the wrap is intended to be used, among other considerations.

Incandescent light bulbs are commonly dome-shaped and comprise a socket connector. Incandescent bulbs produce a warm, yellow-white light that is emitted in many directions. Fluorescent light bulbs are commonly tube-shaped, comprises two socket connectors. Fluorescent light bulbs are produced in numerous sizes and often produce warm color tones, similar to incandescent light bulbs. High-intensity discharge (HID) light bulbs produce light when an arc passes between cathodes in a pressurized tube, causing metallic additives to vaporize. HID light bulbs are often bright-white in color and commonly used for outdoor lighting. Compact fluorescent (CFL) light bulbs are commonly spiral-shaped and comprise one socket connector. CFL light bulbs can be used in most lighting fixtures and range from warm, yellow-white light to bright white light. Finally, light emitting diode (LED) light bulbs produce light when voltage is applied to negatively charged semiconductors, causing electrons to combine and create a unit of light. LED light bulbs are often small in size and, like CFL light bulbs, comprise one socket connector and produce a wide-variety of light. Though each of these types of light bulbs differs slightly in terms of shape, size, and color emitted, the light bulb with which the exemplary system 10 is utilized may be selected from any such type of light bulb, and a skilled artisan will be able to select an appropriate structure and material for the in a particular embodiment based on various considerations, including the intended use of the hue-modifying wrap for a light bulb, the type of light bulb used with the hue-modifying wrap for a light bulb, and anticipated temperature of the outer surface 96 of the light bulb 80, among other considerations. Further, depending on the type of light bulb selected, a skilled artisan will be able to select whether a "caterpillar," "eyelash," or other configuration is proper.

Referring to FIGS. 3 through 5, in the first exemplary system 10 the light bulb 80 is generally dome-shaped and comprises at least one lamp (not illustrated). The lamp is operably connected to one socket connector 90, the connection surrounded by a housing 84. The housing 84 further comprises a first end 86 and second end 88, the first end 86 abutting the socket connector 90 and the second end 88 abutting a bulb portion 92, the bulb portion 92 being generally-dome-shaped. The bulb portion 92 further comprises an inner surface (not illustrated) and outer surface 96 and is preferably comprised of polyvinyl, though is not limited to such. Preferably, the entire bulb portion 92 is light-penetrable, allowing the lamp to emit light in an outward direction. However, the entire bulb portion 92 need not be light-penetrable, only a part thereof. For example, at least a portion of the bulb portion 92 could comprise a reflective coating attached thereto.

Referring now to FIGS. 6A through 9, illustrated is a second exemplary system 40 for modifying the hue of light emitted from a light bulb 81. The light bulb 81 illustrated is of the "R series," "BR series," or "PAR series" type (shape). While the light bulb 81 illustrated is of the "R" or "PAR" series type, a skilled artisan will be able to select an appropriate light bulb shape in a particular embodiment based on various considerations, including the intended use of the light bulb, and the intended type of the light bulb needed, among other considerations.

Figure 6B:
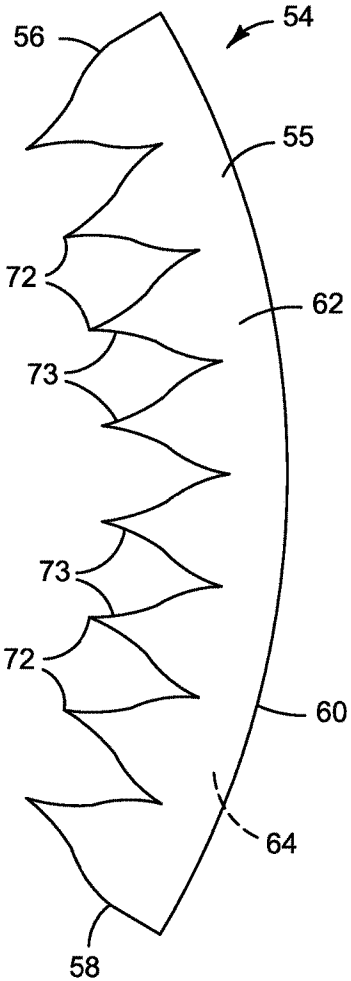
FIG. 6B is a top plan view of a third exemplary hue-modifying wrap.

The second exemplary system 40 comprises one or more hue-modifying wraps for a light bulb 81, for instance the second exemplary hue-modifying wrap 42 (illustrated in FIG. 6A) and/or third exemplary hue-modifying wrap 54 (illustrated in FIG. 6B).

The second hue-modifying wrap 42 of the second exemplary system 40 comprises at least one body portion 43. The body portion 43 comprises a first end 44 extending to a second end 46 and a plurality of projections 70 therebetween. Specifically, each projection 70 comprises an edge 71 adjacent the preceding and/or subsequent projection 70. Further, the body comprises one or more portions for modifying the hue of light passing therethrough.

In the second exemplary system 40 illustrated in these Figures, the light bulb 81 is generally conical-shaped, and of the "R series," "BR series," or "PAR series" type (shape). The light bulb 81 comprises a lamp (not illustrated), at least one bulb portion 93 having an outer surface 97, and at least one socket connector 91. Some exemplary light bulbs 81 will further comprise a housing portion 85 which may contain lighting components (not illustrated) and extend between the socket connector 91 and the bulb portion 93.

The housing portion 85 comprises a first end 87 and second end 89, the first end 87 abutting the socket connector 91 and the second end 89 abutting the bulb portion 93. Preferably, the entire bulb portion 93 is light-penetrable, allowing the lamp to emit light in an outward direction. However, the entire bulb portion 93 need not be light-penetrable, only a part thereof. For example, at least a portion of the bulb portion 93 could comprise a reflective coating attached thereto. The bulb portion 93 further comprises an inner surface (not illustrated) and outer surface 96.

The body portion 43 is configured for transformation between a first, expanded configuration and second, contracted configuration. In the first, expanded configuration, the body portion 43 is, generally, two-dimensional. In this configuration, the body portion 43 is capable of transformation to its second, contracted configuration about at least a portion of a light bulb 81.

When transformed to the second, contracted configuration the plurality of projections 70 adhere to the bulb portion 93 of the light bulb 81, with minimal overlap of the adjacent edges 71, such that at least a portion of the bulb portion 93 of the light bulb is covered.

Figure 6A:
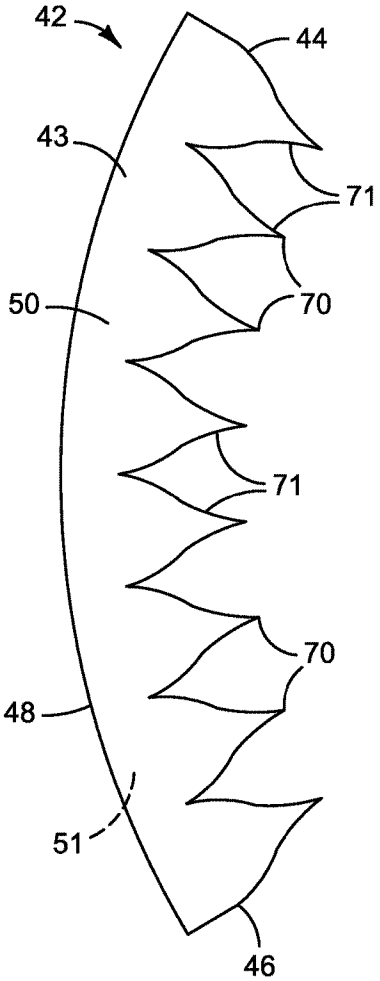
FIG. 6A is a top plan view of a second exemplary hue-modifying wrap.

FIG. 6A illustrates the second exemplary system which comprises a second hue-modifying wrap 42 for a light bulb 81, and FIG. 6B illustrates a third hue-modifying wrap 54 for a light bulb 81. The second hue-modifying wrap 42 and third hue-modifying wrap 54 each comprise generally "eyelash-shaped" designs.

Though in the second exemplary system 40 both a second hue-modifying wrap 42 and a third hue-modifying wrap 54 are present, the second exemplary system 40 could comprise only one hue-modifying wrap which is long enough to completely abut the second end 89, adhering the outer edge 48 to the light bulb portion 93 generally abutting the housing 85.

In the embodiment illustrated in these Figures, the second hue-modifying wrap 42 comprises both a first end 44 and second end 46 with a plurality of projections 70 therebetween. Further, the third hue-modifying wrap 54 comprises both a first end 56 and second end 58, with a plurality of projections 72 therebetween. Both the second hue-modifying wrap 42 and third hue-modifying wrap 54 are preferably symmetrical. Though it is preferable that the second hue-modifying wrap 42 and third hue-modifying wrap 54 are symmetrical, the second hue-modifying wrap 42 and third hue-modifying wrap 54 need not be symmetrical. Rather, the second hue-modifying wrap 42 and third hue-modifying wrap 54 can be configured in any shape or orientation suitable for application to the light bulb 81.

Preferably, the second hue-modifying wrap 42 comprises a first side 50 and second side 51 and the third hue-modifying wrap 54 comprises a first side 62 and a second side (not illustrated). Preferably, the second side 51 of the second hue-modifying wrap 42 comprises an adhesive portion 52 for application to the light bulb 81, and the second side 64 of the third hue-modifying wrap 54 comprises an adhesive portion (not illustrated) for application to the light bulb 81. Preferably, adhesive portion 52 is covered by a backing portion 66, and adhesive portion (not illustrated) of the third hue-modifying wrap 54 is likewise covered by a backing portion (not illustrated), for application to the light bulb 81.

Preferably, the second side 51 of the hue-modifying wrap 42 comprises a body portion 43. The body portion 43 further comprises an adhesive portion 52 for application to the outer surface 97 of the light bulb 81. The adhesive portion 52 can be, for example, a temporary adhesive, though it is preferable that the adhesive portion 52 be generally permanent such that the hue-modifying wrap 42 will remain adhered to the outer surface 97 of the light bulb 81. Any suitable structure and/or material can be used for the adhesive portion, and a skilled artisan will be able to select an appropriate structure and material for the adhesive portion in a particular embodiment based on various considerations, including the intended use of the hue-modifying wrap, the type of light bulb used with the hue-modifying wrap, and anticipated temperature of the outer surface of the light bulb, among other considerations.

Preferably, the second exemplary system 40 is configured for application to a generally conical-shaped light bulb, such as an incandescent reflector bulb, though a skilled artisan will be able to select the appropriate bulb type and/or style.

In the second exemplary system 40, the light bulb 81 is encompassed by at least a second hue-modifying wrap 42, though is preferably encompassed by a second hue-modifying wrap 42 and third hue modifying wrap 54. In this configuration, the plurality of projections 70 adhere to the bulb portion 93 of the light bulb 81, with minimal overlap, such that at least a portion of the bulb portion 93 of the light bulb is covered.

In the second exemplary system 40, the first side 50 of the second hue-modifying wrap 42 comprises indicia thereon. Preferably, the second side 51 of the second hue-modifying wrap 42 and the second side (not illustrated) of the third hue-modifying wrap 54 comprise an adhesive, such as, a generally-permanent adhesive. The adhesive defining an adhesive portion.

Figure 7:
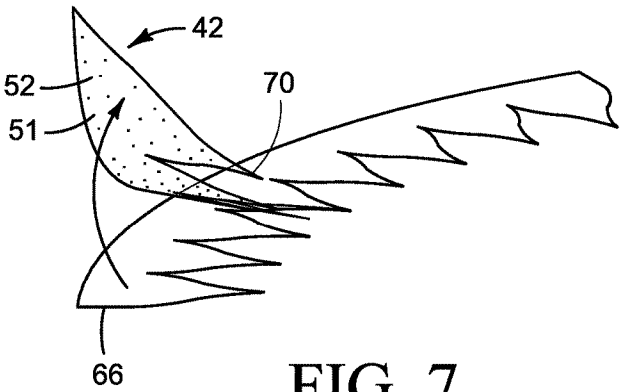
FIG. 7 is a top side perspective view of the second exemplary hue-modifying wrap illustrating the second exemplary hue-modifying wrap being peeled off a backer.

FIG. 7 illustrates the second exemplary hue-modifying wrap 42 as being removed from its backing portion 66, exposing the adhesive portion 52. The adhesive portion 52 can be, for example, a temporary adhesive, though it is preferable that the adhesive be generally permanent such that the hue-modifying wrap will remain adhered to the outer surface 97 of the light bulb 81. When removed from the adhesive portion 52, the second exemplary hue-modifying wrap 42 is capable of being applied to the light bulb 81.

Figure 8:
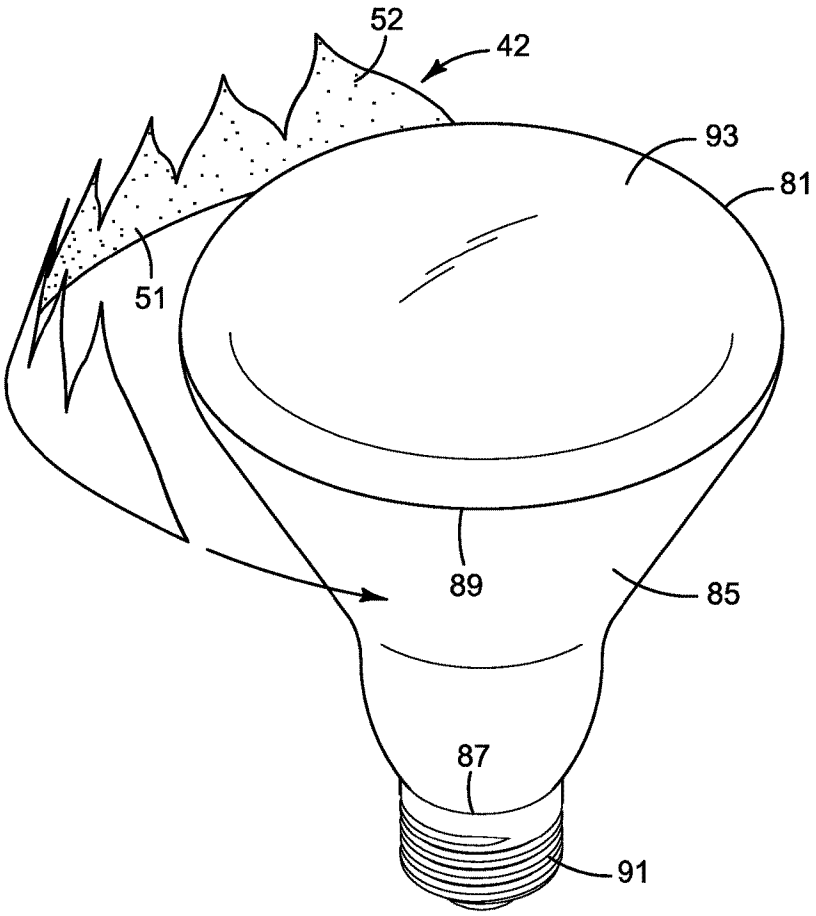
FIG. 8 is a top side perspective view illustrating the second exemplary hue-modifying wrap being applied to a light bulb.
Figure 9:
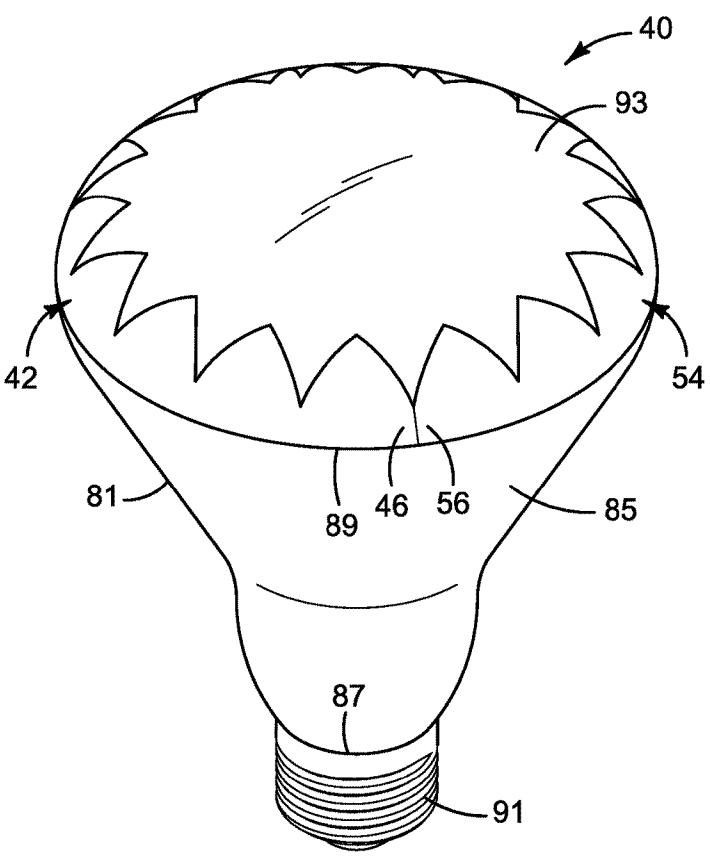
FIG. 9 is a second top side perspective view of embodiment of FIG. 8, illustrating the third exemplary hue-modifying wrap applied to the light bulb.

FIGS. 8 and 9 further illustrate the second exemplary hue-modifying wrap 42 being applied to the light bulb 81. The light bulb 81 illustrated in FIGS. 8 and 9 is a generally conical-shaped light bulb, such as an incandescent reflector bulb. While this is preferred for this exemplary system, a skilled artisan will be able to select a proper light bulb configuration and shape suitable for application by the second exemplary system utilized in other exemplary systems.

The light bulb 81 of the second exemplary system 40 is configured such that the bulb portion 93 is generally light-penetrable and connects with the housing 85, the housing 85 connecting with at least one socket connector 91. Further, the connection of the bulb portion 93 and housing 85 creates an enclosure for the lamp (not illustrated).

To apply the second exemplary system hue-modifying wrap 42, the backing portion 66 is removed from the second side 51 of the second hue-modifying wrap 42, exposing the adhesive portion 52. The outer edge 48 is then generally aligned with the second end 89, adhering the outer edge 48 to the bulb portion 93 generally abutting the housing 85. The second hue-modifying wrap 42 is then transformed to its second, contracted configuration by adhering the second hue-modifying wrap 42 to the light bulb 81 by adhering each projection 70 to the bulb portion 93. It is preferable that, in this second, contracted configuration, little-to-no overlap of the plurality of projections 70 exists.

Preferably, application of the second hue-modifying wrap 42 covers approximately half of the entire bulb portion 93, though in certain embodiments the second exemplary system 40 could cover up to the entire bulb portion 93. Thus, it is preferable that after application of the second hue-modifying wrap 42, the third hue-modifying wrap 42 be applied.

To apply the third hue-modifying wrap 54 of the second exemplary system 40, the backing portion (not illustrated) is removed from the second side (not illustrated) of the third hue-modifying wrap 54, exposing the adhesive portion (not illustrated). The outer edge 60 of the third hue-modifying wrap 54 is then aligned with and adhered to the bulb portion 93 such that the second end 46 of the second hue-modifying wrap 42 meets with the first end 56 of the third hue-modifying wrap 54 and the first end 44 of the second hue-modifying portion 42 meets with the second end 58 of the third hue-modifying wrap 54. The third hue-modifying wrap 54 is then transformed to its second, contracted configuration by adhering the second side 64 to the bulb portion 93 by adhering each projection 72 to the bulb portion 93.

Once the second hue-modifying wrap 42 and third hue-modifying wrap 54 are transformed to the second, contracted configuration, the application process is complete. The second hue-modifying wrap 42 and third hue-modifying wrap 54 are adhered to the light bulb 81 such that the outermost surface of the bulb portion 93 is generally covered, leaving the centermost region of the bulb portion 93 exposed.

Any suitable structure and/or material can be used for the eyelash-shaped hue-modifying wrap for a light bulb, and a skilled artisan will be able to select an appropriate structure and material for use in a particular embodiment based on various considerations, including the intended use of the hue-modifying wrap for a light bulb, the type of light bulb used with the hue-modifying wrap for a light bulb, and the equipment and/or accessories with which the hue-modifying wrap for a light bulb is intended to be used, among other considerations.

Further, the first side 50 of the second hue-modifying wrap 42 and first side 62 of the third hue-modifying wrap 54 can comprise a multiplicity of colors, designs, and/or patterns. Preferably, only the first sides 50, 62 are covered, though both the first sides and second sides can be covered. A skilled artisan will be able to select the appropriate color, design, and/or pattern of the hue-modifying wrap for sue in a particular embodiment based on various considerations, including the intended use of the hue-modifying wrap for a light bulb and the location in which it will be used.

In addition to comprising a multiplicity of colors, designs, and/or patterns, the material of the hue-modifying wrap is selected from the group consisting of polyvinyl, polyester, polyolefin, polyvinyl chloride (PVC), polyethylene, and polypropylene. The material selected must be able to withstand surface temperatures of the outer surface 97 of the light bulb 81 ranging from −40° F. to 186° F., without failing or deforming.

Further, it is preferable that the exemplary polymeric material able to be stretched to a stretched length that is about one-hundred and twenty (120) percent of its relaxed length. While such a degree of stretchability is preferred, a skilled artisan may select a polymeric material having no stretchability, less stretchability or more stretchability than the preferred about one-hundred and twenty (120) percent in a particular embodiment based on various considerations, including the intended use of the hue-modifying wrap, the intended arena within which the hue-modifying wrap will be used, and the equipment and/or accessories with which the hue-modifying wrap is intended to be used, among other considerations. By exhibiting such an elasticity rating of about one-hundred twenty (120) percent, the first end and second end of the hue-modifying wrap, as well as the plurality of projections, are able to stretch and be adhered about the outer surface 97 of the light bulb 81 without excessive deformation of the colors, designs, and/or patterns printed thereon. Additionally, the presence of a plurality of projections allows the hue-modifying wrap 42 to be stretched and applied equidistantly about the second end 89. By applying the hue-modifying wrap 42 in such a manner, any designs and/or patterns present on the hue-modifying wrap 42 are less-distorted.

In the second exemplary system 40, the light bulb 81 is generally conical-shaped and comprises at least one lamp. The light bulb 81 is operably connected to one socket connector, the connection surrounded by a housing. The housing further comprises a first end and second end, the first end abutting the socket connector and the second end abutting a body, the body being conical-shaped. The body further comprises an inner surface (not illustrated) and outer surface (not illustrated) and is preferably polyvinyl, though is not limited to such. Preferably, the entire body is light-penetrable, allowing the lamp to emit light in an outward direction. However, the entire body need not be light-penetrable, only a part thereof. For example, at least a portion of the body could comprise a reflective coating attached thereto.

Figure 10:
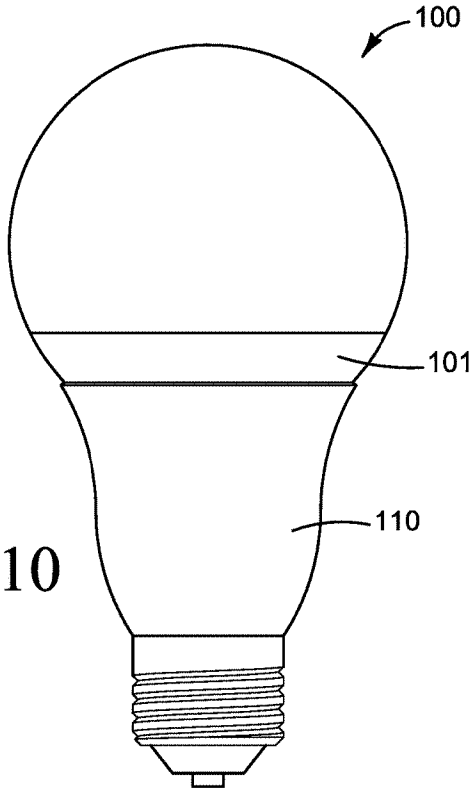
FIG. 10 is a side view of the fourth exemplary hue-modifying wrap illustrating the wrap fully applied to a light bulb.

FIG. 10 illustrates a third exemplary system 100 for modifying the hue of light emitted from a light bulb 110. The third exemplary system 100 comprises one or more hue-modifying wraps 101 for the light bulb 110.

The third exemplary system 100 comprises at least one hue-modifying wrap 101 extending about the circumference of the light bulb 110. The hue-modifying wrap 101 preferably comprises indicia printed thereon for modifying the hue of light passing therethrough. The third exemplary system 100 is configured such that hue-modifying wrap 101 modifies the hue of only a portion of the total light emitted by the light bulb 110.

The hue-modifying wrap 101 is, preferably, comprised of a polymeric material, such as polyvinyl, polyester, polyolefin, polyvinyl chloride (PVC), polyethylene, or polypropylene. Though this material is preferable, a skilled artisan will be able to select an appropriate structure and material for the hue-modifying wrap in a particular embodiment based on various considerations, including the intended use of the hue-modifying wrap, the type of light bulb used with the hue-modifying wrap, and anticipated temperature of the outer surface of the light bulb, among other considerations.

The hue-modifying wrap is configured for transformation between a first, expanded configuration and second, contracted configuration. In the first, expanded configuration, the hue-modifying wrap is, generally, two-dimensional. In this configuration, the hue-modifying wrap is capable of transformation to its second, contracted configuration about a light bulb. When transformed to the second, contracted configuration the hue-modifying wrap is adhered to the surface of the light bulb, with minimal overlap, such that at least a portion of the outer circumference of the light bulb is covered.

The light bulb 110 illustrated in FIG. 10 is a generally dome-shaped light bulb, such as a LED light bulb. Further, it is preferable that the light bulb be an "A series" type (shape). While it is preferable that the light bulb be of the "A series" type, a skilled artisan will be able to select an appropriate light bulb shape in a particular embodiment based on various considerations, including the intended use of the light bulb, and the intended type of the light bulb needed, among other considerations.

One exemplary method of applying the third exemplary system to a light bulb can be described as follows. To apply the third exemplary system to a light bulb, the hue-modifying wrap is applied directly to the light bulb. For example, the hue-modifying wrap can be printed directly on the light bulb. A skilled artisan will be able to select an appropriate method for applying the hue-modifying wrap directly to the body of the light bulb, including the intended use of the hue-modifying wrap, the type of light bulb used with the hue-modifying wrap, and the equipment and/or accessories with which the hue-modifying wrap is intended to be used, among other considerations.

Preferably, application of the hue-modifying wrap covers approximately a portion of the entire circumference of the light bulb, though in certain embodiments the third exemplary system could cover a portion of the circumference of the light bulb up to the entire body portion.

Any suitable structure and/or material can be used for the third exemplary system, and a skilled artisan will be able to select an appropriate structure and material for use in a particular embodiment based on various considerations, including the intended use of the hue-modifying wrap, the type of light bulb used with the hue-modifying wrap, and the equipment and/or accessories with which the hue-modifying wrap is intended to be used, among other considerations. The material comprises the hue-modifying wrap is preferably selected from the group consisting of polyvinyl, polyester, polyolefin, polyvinyl chloride (PVC), polyethylene, and polypropylene. It is preferred that the exemplary polymeric material selected must be able to withstand surface temperatures of the light bulb ranging from −40° F. to 186° F., without failing or deforming. However, a skilled artisan will be able to select an appropriate structure and material for the hue-modifying wrap in a particular embodiment based on various considerations, including the intended use of the wrap, the intended arena within which the wrap will be used, and the equipment and/or accessories with which the wrap is intended to be used, among other considerations.

Further, it is preferable that the exemplary polymeric material refracts red light throughout the light bulb and fills in the missing color hue in the 650-750 nm wavelength of a LED light bulb, resulting in the overall light emitted from the light bulb being a desired hue. While this wavelength range is preferred in this exemplary method/system, other exemplary methods/systems will be configured to fill in other color hues and/or modify the overall light emitted from the light bulb to be a desired hue. A skilled artisan will be able to select an appropriate structure, placement and material for the polymeric material in a particular embodiment based on various considerations, including desired color hues, the intended use of the hue-modifying wrap, the intended arena within which the hue-modifying wrap will be used, and the equipment and/or accessories with which the hue-modifying wrap is intended to be used, among other considerations.

Additionally, it is preferable that the exemplary polymeric material able to be stretched to a stretched length that is about one-hundred and twenty (120) percent of its relaxed length. While such a degree of stretchability is preferred, a skilled artisan may select a polymeric material having no stretchability, less stretchability or more stretchability than the preferred about one-hundred and twenty (120) percent in a particular embodiment based on various considerations, including the intended use of the hue-modifying wrap, the intended arena within which the hue-modifying wrap will be used, and the equipment and/or accessories with which the hue-modifying wrap is intended to be used, among other considerations. By exhibiting such an elasticity rating of about one-hundred and twenty (120) percent, the first end and second end of the hue-modifying wrap is able to stretch and be adhered about the outer surface 97 of the light bulb 81 without excessive deformation of the colors, designs, and/or patterns printed thereon. However, a skilled artisan will be able to select an appropriate structure and material for the hue-modifying wrap in a particular embodiment based on various considerations, including the intended use of the hue-modifying wrap, the intended arena within which the hue-modifying wrap will be used, and the equipment and/or accessories with which the hue-modifying wrap is intended to be used, among other considerations.

In the third exemplary hue-modifying wrap, a skilled artisan will be able to select an appropriate manner of attaching the wrap to the light bulb in a particular embodiment based on various considerations, including the intended use of the light bulb, the intended arena within which the light bulb will be used, and the equipment and/or accessories with which the light bulb is intended to be used, among other considerations. For example, the wrap could comprise a shrinkable material that is shrunken onto the light bulb via heat or another process, the wrap could comprise a "static-cling" material that is applied to the light bulb, the wrap could be printed on the light bulb, etc.

Figure 11:
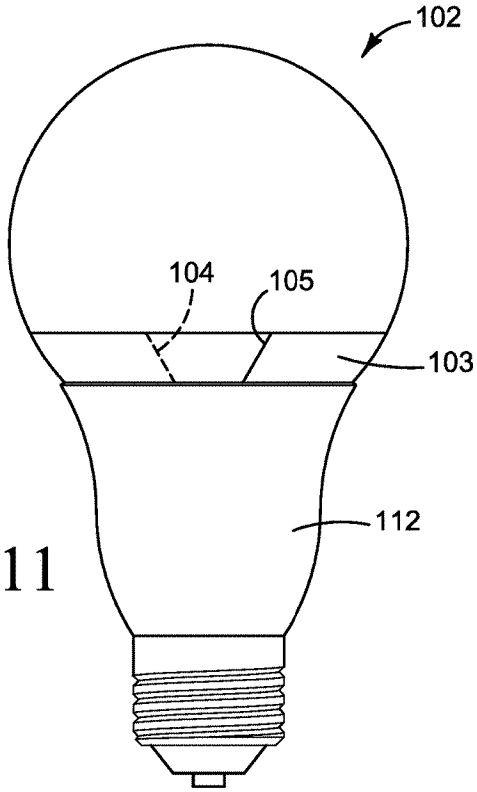
FIG. 11 is a side view of the fifth exemplary hue-modifying wrap illustrating the wrap fully applied to a light bulb.
Figure 12:
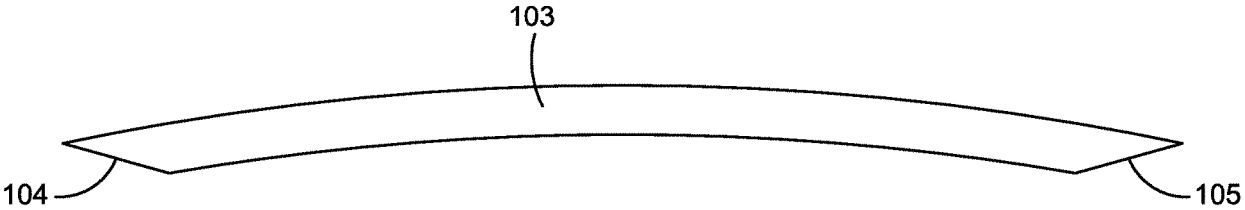
FIG. 12 a side view of the fifth exemplary hue-modifying wrap.

FIGS. 11 and 12 illustrate a fourth exemplary system for modifying the hue of light emitted from a light bulb 102. The fourth exemplary system comprises one or more hue-modifying wraps for a light bulb.

The fourth exemplary system comprises at least one hue-modifying wrap 103 extending about the circumference of the light bulb 112. The hue-modifying wrap preferably comprises indicia printed thereon for modifying the hue of light passing therethrough. The fourth exemplary system is configured such that hue-modifying wrap modifies the hue of light passing therethrough, thus only a portion of the total light emitted by the light bulb.

The hue-modifying wrap is, preferably, comprised of a polyvinyl material. Though this material is preferable, a skilled artisan will be able to select an appropriate structure and material for the hue-modifying wrap in a particular embodiment based on various considerations, including the intended use of the hue-modifying wrap, the type of light bulb used with the hue-modifying wrap, and anticipated temperature of the outer surface of the light bulb, among other considerations.

The hue-modifying wrap is configured for transformation between a first, expanded configuration and second, contracted configuration. In the first, expanded configuration, the hue-modifying wrap is, generally, two-dimensional. In this configuration, the hue-modifying wrap is capable of transformation to its second, contracted configuration about a light bulb. When transformed to the second, contracted configuration the hue-modifying wrap is adhered to the surface of the light bulb, with minimal overlap, such that at least a portion of the outer circumference of the light bulb is covered.

The light bulb illustrated in FIGS. 11 and 12 is a generally dome-shaped light bulb, such as a LED light bulb. While this is preferred for this exemplary system, a skilled artisan will be able to select a proper light bulb configuration and shape suitable for application by the fourth exemplary system utilized in other exemplary systems.

One exemplary method of applying the fourth exemplary system to a light bulb can be described as follows. To apply the fourth exemplary system to a light bulb, the backing portion is removed from the second side of the hue-modifying wrap, exposing the adhesive portion. The outer edge is then aligned with the second end, adhering the outer edge to the body portion abutting the housing. The hue-modifying wrap is then transformed to its second, contracted configuration by adhering the first end of the hue-modifying wrap to the light bulb and by stretching the hue-modifying wrap about the circumference of the light bulb, adhering it thereto. It is preferable that, in this second, contracted configuration, little-to-no overlap of the first end and second end exists.

Preferably, application of the hue-modifying wrap covers approximately a portion of the entire circumference of the light bulb, though in certain embodiments the fourth exemplary system could cover a portion of the circumference of the light bulb up to the entire body portion.

Any suitable structure and/or material can be used for the fourth exemplary system, and a skilled artisan will be able to select an appropriate structure and material for use in a particular embodiment based on various considerations, including the intended use of the hue-modifying wrap, the type of light bulb used with the hue-modifying wrap, and the equipment and/or accessories with which the hue-modifying wrap is intended to be used, among other considerations. The material comprises the hue-modifying wrap is preferably selected from the group consisting of polyvinyl, polyester, polyolefin, polyvinyl chloride (PVC), polyethylene, and polypropylene. It is preferred that the polymeric exemplary polymeric material selected must be able to withstand surface temperatures of the light bulb ranging from −40° F. to 186° F., without failing or deforming. However, a skilled artisan will be able to select an appropriate structure and material for the hue-modifying wrap in a particular embodiment based on various considerations, including the intended use of the wrap, the intended arena within which the wrap will be used, and the equipment and/or accessories with which the wrap is intended to be used, among other considerations.

Further, it is preferable that the exemplary polymeric material refracts red light throughout the light bulb and fills in the missing color hue in the 650-750 nm wavelength of a LED light bulb, resulting in the overall light emitted from the light bulb being a desired hue. While this wavelength range is preferred in this exemplary method/system, other exemplary methods/systems will be configured to fill in other color hues and/or modify the overall light emitted from the light bulb to be a desired hue. A skilled artisan will be able to select an appropriate structure, placement and material for the polymeric material in a particular embodiment based on various considerations, including desired color hues, the intended use of the hue-modifying wrap, the intended arena within which the hue-modifying wrap will be used, and the equipment and/or accessories with which the hue-modifying wrap is intended to be used, among other considerations.

Further, it is preferable that the exemplary polymeric material able to be stretched to a stretched length that is about one-hundred and twenty (120) percent of its relaxed length. While such a degree of stretchability is preferred, a skilled artisan may select a polymeric material having no stretchability, less stretchability or more stretchability than the preferred about one-hundred and twenty (120) percent in a particular embodiment based on various considerations, including the intended use of the hue-modifying wrap, the intended arena within which the hue-modifying wrap will be used, and the equipment and/or accessories with which the hue-modifying wrap is intended to be used, among other considerations. By exhibiting such an elasticity rating of about one-hundred and twenty (120) percent, the first end and second end of the hue-modifying wrap is able to stretch and be adhered about the outer surface 97 of the light bulb 81 without excessive deformation of the colors, designs, and/or patterns printed thereon. However, a skilled artisan will be able to select an appropriate structure and material for the hue-modifying wrap in a particular embodiment based on various considerations, including the intended use of the hue-modifying wrap, the intended arena within which the hue-modifying wrap will be used, and the equipment and/or accessories with which the hue-modifying wrap is intended to be used, among other considerations.

In the fourth exemplary hue-modifying wrap, a skilled artisan will be able to select an appropriate manner of attaching the wrap to the light bulb in a particular embodiment based on various considerations, including the intended use of the light bulb, the intended arena within which the light bulb will be used, and the equipment and/or accessories with which the light bulb is intended to be used, among other considerations. For example, the wrap could comprise a shrinkable material that is shrunken onto the light bulb via heat or another process, the wrap could comprise a "static-cling" material that is applied to the light bulb, the wrap could be printed on the light bulb, etc.

Additional exemplary methods of applying exemplary systems to a light bulb can be described as follows. To apply an exemplary system to a light bulb, the hue-modifying wrap is applied directly to the light bulb. For example, the hue-modifying wrap can be printed directly on the light bulb. A skilled artisan will be able to select an appropriate method for applying the hue-modifying wrap directly to the body of the light bulb, including the intended use of the hue-modifying wrap, the type of light bulb used with the hue-modifying wrap, and the equipment and/or accessories with which the hue-modifying wrap is intended to be used, among other considerations.

Preferably, application of the hue-modifying wrap covers approximately a portion of the entire circumference of the light bulb, though in certain embodiments an exemplary system could cover a portion of the circumference of the light bulb up to the entire body portion.

A fifth exemplary system (not illustrated) comprises at least one hue-modifying wrap for a light bulb. The light bulb comprises a lamp, at least one bulb portion having an outer surface, and a base portion. The base portion comprises at least one socket connector. The hue-modifying wrap configured for extending about at least a portion of the outer surface of the bulb portion which is generally adjacent the base portion of the light bulb. The hue-modifying wrap for modifying the hue of light passing therethrough, the light passing therethrough being only a portion of the total light emitted by the light bulb.

The hue-modifying wrap in the fifth exemplary system is, preferably, comprised of a hue-modifying material, such as colored polymeric material, acrylic paint, paint, ink, or similar such material. Though this material is preferable, a skilled artisan will be able to select an appropriate hue-modifying material for the hue-modifying wrap in a particular embodiment based on various considerations, including the intended use of the hue-modifying wrap, the type of light bulb used with the hue-modifying wrap, and anticipated temperature of the outer surface of the light bulb, among other considerations.

The light bulb in the fifth exemplary system is preferably a generally dome-shaped light bulb, such as a LED light bulb, incandescent light bulb, fluorescent light bulb, high-intensity discharge (HID) light bulbs, or compact fluorescent (CFL) light bulbs. While this is preferred for this exemplary system, a skilled artisan will be able to select a proper light bulb configuration and shape suitable for application by the fifth exemplary system utilized in other exemplary systems.

One exemplary method of applying the fifth exemplary system to a light bulb can be described as follows. To apply the fifth exemplary system to a light bulb, the hue-modifying wrap is printed directly on the outer surface of the light bulb. Specifically, the hue-modifying wrap is printed on at least a portion of the outer surface of the bulb portion which is generally adjacent the base portion.

Preferably, application of the hue-modifying wrap covers approximately a portion of the outer surface of the bulb portion, though in certain embodiments the fifth exemplary system could cover a portion of the outer surface of the light bulb up to the entire outer surface.

Further, it is preferable that the hue-modifying material refracts red light throughout the light bulb and fills in the missing color hue in the 650-750 nm wavelength of a LED light bulb, resulting in the overall light emitted from the light bulb being a desired hue. While this wavelength range is preferred in this exemplary method/system, other exemplary methods/systems will be configured to fill in other color hues and/or modify the overall light emitted from the light bulb to be a desired hue. A skilled artisan will be able to select an appropriate structure, placement and material for the polymeric material in a particular embodiment based on various considerations, including desired color hues, the intended use of the hue-modifying wrap, the intended arena within which the hue-modifying wrap will be used, and the equipment and/or accessories with which the hue-modifying wrap is intended to be used, among other considerations.

In the fifth exemplary hue-modifying wrap, a skilled artisan will be able to select an appropriate light bulb in a particular embodiment based on various considerations, including the intended use of the light bulb, the intended arena within which the light bulb will be used, and the equipment and/or accessories with which the light bulb is intended to be used, among other considerations. For example, generally-known methods of printing on a light bulb include tampography (also known as "pad printing"), hand-printing, painted on with a brush, sprayed on, dipped in a solution, silk-screened, applied with ink, etc.

A sixth exemplary system (not illustrated) comprises at least one hue-modifying wrap for a light bulb. The light bulb comprises a lamp, at least one bulb portion having an outer surface, and a base portion. The base portion comprises at least one socket connector. The hue-modifying wrap being generally major sector shaped, having an angle at the center of the circle of more than one-hundred and eighty (180) degrees. As such, the hue-modifying wrap portion having a minor sector removed therefrom. Alternatively, the hue-modifying wrap could be circular shaped.

The hue-modifying wrap portion is configured for being placed on or adjacent the center point of the body portion of a light bulb, and stretched or overlapped (if necessary) to result in the center point of the body, and the area adjacent thereto, of the light bulb being covered with a generally circular hue-modifying wrap.

The hue-modifying wrap for modifying the hue of light passing therethrough, the light passing therethrough being only a portion of the total light emitted by the light bulb.

The hue-modifying wrap in this exemplary system is, preferably, comprised of a hue-modifying material, such as polyvinyl material. Though this material is preferable, a skilled artisan will be able to select an appropriate hue-modifying material for the hue-modifying wrap in a particular embodiment based on various considerations, including the intended use of the hue-modifying wrap, the type of light bulb used with the hue-modifying wrap, and anticipated temperature of the outer surface of the light bulb, among other considerations.

Preferably, application of the hue-modifying wrap covers a portion of the outer surface of the bulb portion, though in certain embodiments the sixth exemplary system could cover a portion of the outer surface of the light bulb up to the entire outer surface.

Further, it is preferable that the hue-modifying material refracts red light throughout the light bulb and fills in the missing color hue in the 650-750 nm wavelength of a LED light bulb, resulting in the overall light emitted from the light bulb being a desired hue. While this wavelength range is preferred in this exemplary method/system, other exemplary methods/systems will be configured to fill in other color hues and/or modify the overall light emitted from the light bulb to be a desired hue. A skilled artisan will be able to select an appropriate structure, placement and material for the polymeric material in a particular embodiment based on various considerations, including desired color hues, the intended use of the hue-modifying wrap, the intended arena within which the hue-modifying wrap will be used, and the equipment and/or accessories with which the hue-modifying wrap is intended to be used, among other considerations.

A seventh exemplary system (not illustrated) comprises at least two hue-modifying wraps for a light bulb. The light bulb comprises a lamp, at least one bulb portion having an outer surface, and a base portion. The base portion comprises at least one socket connector. The hue-modifying wraps comprising a first hue-modifying wrap portion and a second hue-modifying wrap portion.

The first hue-modifying wrap portion being generally major sector shaped, having an angle at the center of the circle of more than one-hundred and eighty (180) degrees. As such, the first hue-modifying wrap portion will have a minor sector removed therefrom. Alternatively, the hue-modifying wrap could be circular shaped.

The first hue-modifying wrap portion is configured for being placed on or adjacent the center point of the body portion of a light bulb, and stretched or overlapped (if necessary) to result in the general center point area of the body portion of the light bulb generally covered with a generally circular hue-modifying wrap.

The second hue-modifying wrap portion is configured for being placed about a portion of the outer surface of the bulb portion adjacent the portion of the outer surface of the bulb portion covered by the first hue-modifying wrap portion. In conjunction with the first hue-modifying wrap portion, preferably, application of the first hue-modifying wrap and the second hue-modifying wrap covers a portion of the outer surface of the bulb portion, though in certain embodiments the seventh exemplary system could cover a portion of the outer surface of the light bulb up to the entire outer surface.

The hue-modifying wraps are each configured for extending about at least a portion of the outer surface of the bulb portion which is generally adjacent the base portion of the light bulb. The hue-modifying wrap for modifying the hue of light passing therethrough, the light passing therethrough being only a portion of the total light emitted by the light bulb.

The hue-modifying wrap in this exemplary system is, preferably, comprised of a hue-modifying material, such as polyvinyl material. Though this material is preferable, a skilled artisan will be able to select an appropriate hue-modifying material for the hue-modifying wrap in a particular embodiment based on various considerations, including the intended use of the hue-modifying wrap, the type of light bulb used with the hue-modifying wrap, and anticipated temperature of the outer surface of the light bulb, among other considerations.

Preferably, application of the hue-modifying wrap covers approximately a portion the outer surface of the bulb portion, though in certain embodiments the seventh exemplary system could cover a portion of the outer surface of the light bulb up to the entire outer surface.

Further, it is preferable that the hue-modifying material refracts red light throughout the light bulb and fills in the missing color hue in the 650-750 nm wavelength of a LED light bulb, resulting in the overall light emitted from the light bulb being a desired hue. While this wavelength range is preferred in this exemplary method/system, other exemplary methods/systems will be configured to fill in other color hues and/or modify the overall light emitted from the light bulb to be a desired hue. A skilled artisan will be able to select an appropriate structure, placement and material for the polymeric material in a particular embodiment based on various considerations, including desired color hues, the intended use of the hue-modifying wrap, the intended arena within which the hue-modifying wrap will be used, and the equipment and/or accessories with which the hue-modifying wrap is intended to be used, among other considerations.

An eighth exemplary system (not illustrated) comprises at least one hue-modifying wrap for a light bulb. The light bulb comprises a lamp, at least one bulb portion having an outer surface, and a base portion. The base portion comprises at least one socket connector. The hue-modifying wrap portion is configured being placed about a portion of the outer surface of the bulb portion.

The hue-modifying wrap portion is configured for extending about at least a portion of the outer surface of the bulb portion which is generally adjacent the base portion of the light bulb.

The hue-modifying wrap for modifying the hue of light passing therethrough, the light passing therethrough being only a portion of the total light emitted by the light bulb. The hue-modifying wrap in this exemplary system is, preferably, comprised of a hue-modifying material, such as polyvinyl material. Though this material is preferable, a skilled artisan will be able to select an appropriate hue-modifying material for the hue-modifying wrap in a particular embodiment based on various considerations, including the intended use of the hue-modifying wrap, the type of light bulb used with the hue-modifying wrap, and anticipated temperature of the outer surface of the light bulb, among other considerations.

Preferably, application of the hue-modifying wrap covers approximately a portion of the outer surface of the bulb portion, though in certain embodiments the eighth exemplary system could cover a portion of the outer surface of the light bulb up to the entire outer surface.

Further, it is preferable that the hue-modifying material refracts red light throughout the light bulb and fills in the missing color hue in the 650-750 nm wavelength of a LED light bulb, resulting in the overall light emitted from the light bulb being a desired hue. While this wavelength range is preferred in this exemplary method/system, other exemplary methods/systems will be configured to fill in other color hues and/or modify the overall light emitted from the light bulb to be a desired hue. A skilled artisan will be able to select an appropriate structure, placement and material for the polymeric material in a particular embodiment based on various considerations, including desired color hues, the intended use of the hue-modifying wrap, the intended arena within which the hue-modifying wrap will be used, and the equipment and/or accessories with which the hue-modifying wrap is intended to be used, among other considerations.

Additional exemplary methods of applying exemplary systems to a light bulb can be described as follows. To apply an exemplary system to a light bulb, the hue-modifying wrap is applied directly to the light bulb. For example, the hue-modifying wrap can be printed directly on the light bulb. A skilled artisan will be able to select an appropriate method for applying the hue-modifying wrap directly to the body of the light bulb, including the intended use of the hue-modifying wrap, the type of light bulb used with the hue-modifying wrap, and the equipment and/or accessories with which the hue-modifying wrap is intended to be used, among other considerations.

Preferably, application of the hue-modifying wrap covers approximately a portion of the outer surface of the bulb portion, though in certain embodiments an exemplary system could cover a portion of outer surface of the bulb portion up to the entire outer surface of the bulb portion.

The foregoing detailed description provides exemplary embodiments of the invention and includes the best mode for practicing the invention. The description and illustration of these embodiments is intended only to provide examples of the invention, and not to limit the scope of the invention, or its protection, in any manner.

The foregoing detailed description provides exemplary embodiments of the invention and includes the best mode for practicing the invention. The description and illustration of these embodiments is intended only to provide examples of the invention, and not to limit the scope of the invention, or its protection, in any manner.

What is claimed is:

1. A hue-modifying wrap for a light bulb, the light bulb comprising at least one lamp, at least one socket connector configured for coupling with a power source, and a housing comprising at least one light-penetrable surface, the lamp being operatively connected to the socket connector and the socket connector connected to the housing such that the lamp is disposed within the housing, said hue-modifying wrap comprising:

at least one hue-modifying portion, the hue-modifying portion being generally light-penetrable, the hue-modifying portion comprising a plurality of projections, the projections shaped for operative transition between a first, expanded configuration and second, contracted configuration covering at least a portion of the light-penetrable surface;

wherein the hue-modifying wrap is affixed to at least a portion of the light-penetrable surface as a result of the hue-modifying portion transitioning between the expanded configuration and contracted configuration, the hue-modifying portion further altering the hue of light emitted from the light bulb.

2. The hue-modifying wrap of claim 1, wherein the hue-modifying wrap comprises an adhesive side and a non-adhesive side, the adhesive side for application to at least a portion of the light-penetrable surface.

3. The hue-modifying wrap of claim 1, wherein the hue-modifying wrap comprises indicia printed thereon.

4. The hue-modifying wrap of claim 3, wherein the hue modifying wrap comprises a polymeric material selected from the group consisting of polyvinyl, polyester, polyolefin, polyvinyl chloride (PVC), polyethylene, and polypropylene.

5. The hue-modifying wrap of claim 2, wherein the adhesive side further comprises an adhesive.

6. The hue-modifying wrap of claim 5, wherein the adhesive is a permanent adhesive.

7. The hue-modifying wrap of claim 1, wherein the hue-modifying wrap comprises a first end and second end, the first end being opposite the second end, the first end defining said plurality of projections.

8. The hue-modifying wrap of claim 1, wherein the hue-modifying wrap comprises an adhesive side and a non-adhesive side, the adhesive side for application to at least a portion of the light-penetrable surface, the hue-modifying wrap further comprising a first end and second end, the first end being opposite the second end, the first end defining said plurality of projections.

9. The hue-modifying wrap of claim 1, wherein the hue-modifying wrap comprises indicia printed thereon, the hue-modifying wrap further comprising a first end and second end, the first end being opposite the second end, the first end defining said plurality of projections.

10. The hue-modifying wrap of claim 1, wherein the hue-modifying wrap comprises indicia printed thereon, the hue-modifying wrap further comprising an adhesive side and a non-adhesive side, the adhesive side for application to at least a portion of the light-penetrable surface, the hue-modifying wrap further comprising a first end and second end, the first end being opposite the second end, the first end defining said plurality of projections.

11. The hue-modifying wrap of claim 1, wherein the hue-modifying wrap comprises indicia printed thereon, the hue-modifying wrap further comprising an adhesive side and a non-adhesive side, the adhesive side for application to at least a portion of the light-penetrable surface, the adhesive side further comprising an adhesive, the hue-modifying wrap further comprising a first end and second end, the first end being opposite the second end, the first end defining said plurality of projections.

12. The hue-modifying wrap of claim 11, wherein the adhesive side further comprises an adhesive, the adhesive being a generally-permanent adhesive.

13. A system for modifying the hue of light emitted from a light bulb, said system comprising:

a light bulb, the light bulb further comprising at least one lamp, at least one socket connector configured for coupling with a power source, and a housing comprising at least one light-penetrable surface, the lamp being operatively connected to the socket connector and the socket connector connected to the housing such that the lamp is disposed within the housing; and a hue-modifying wrap, the hue-modifying wrap being a colored, generally light-penetrable material, the hue-modifying wrap comprising a first, adhesive side and second, non-adhesive side, the adhesive side comprising an adhesive for application to at least a portion of the light-penetrable surface, the hue-modifying wrap shaped for operative transition between a first, expanded configuration and second, contracted configuration to at least a portion of the light-penetrable surface;

wherein the hue-modifying wrap is affixed to at least a portion of the light-penetrable surface as a result of the hue-modifying wrap transitioning between the expanded configuration and contracted configuration, the hue-modifying wrap further altering the hue of light emitted from the light bulb.

14. The system of claim 13, wherein the hue-modifying wrap is comprised of a polymeric material.

15. The system of claim 13 wherein the first, adhesive side further comprises an adhesive.

16. The system of claim 13 wherein the hue-modifying wrap comprises a first end and second end, the first end being opposite the second end, the first end defining a plurality of projections, the projections for operative transition between a first, expanded configuration and second, contracted configuration to at least a portion of the light-penetrable surface.

17. The system of claim 13, wherein the hue-modifying wrap is comprised of a polymeric material, the hue-modifying wrap further comprising a first end and second end, the first end being opposite the second end, the first end defining a plurality of projections, the projections for operative transition between a first, expanded configuration and second, contracted configuration to at least a portion of the light-penetrable surface.

18. The system of claim 13 wherein the hue-modifying wrap is comprised of a polymeric material, the hue-modifying wrap further comprising an adhesive side and a non-adhesive side, the adhesive side for application to at least a portion of the light-penetrable surface, the hue-modifying wrap further comprising a first end and second end, the first end being opposite the second end, the first end defining a plurality of projections, the projections for operative transition between a first, expanded configuration and second, contracted configuration to at least a portion of the light-penetrable surface.

19. The system of claim 13 wherein the hue-modifying wrap comprises is comprised of a polymeric material, the hue-modifying wrap further comprising an adhesive side and a non-adhesive side, the adhesive side for application to at least a portion of the light-penetrable surface, the adhesive side further comprising an adhesive, the hue-modifying wrap further comprising a first end and second end, the first end being opposite the second end, the first end defining a plurality of projections, the projections for operative transition between a first, expanded configuration and second, contracted configuration to at least a portion of the light-penetrable surface.

20. A system for modifying the hue of light emitted from a light bulb, said system comprising:

a light bulb, the light bulb further comprising at least one lamp, at least one socket connector configured for coupling with a power source, and a housing comprising at least one light-penetrable surface, the lamp being operatively connected to the socket connector and the socket connector connected to the housing such that the lamp is disposed within the housing; and a hue-modifying wrap, the hue-modifying wrap being a generally flexible polymeric material, the polymeric material being generally light-penetrable, the hue-modifying wrap further comprising a first, adhesive side and second, non-adhesive side, the adhesive side comprising a generally-permanent adhesive for application to the light-penetrable surface, the hue-modifying wrap comprising a first end and second end, the first end being opposite the second end and defining a plurality of projections, the projections for operative transition between a first, expanded configuration and second, contracted configuration to the light-penetrable surface;

wherein the adhesive side of the hue-modifying wrap is affixed to the entirety of the light-penetrable surface as a result of the projections transitioning between the expanded configuration and contracted configuration, the hue-modifying wrap further altering the hue of light emitted from the light bulb.

21. A hue-modifying wrap for a light bulb, the light bulb comprising at least one lamp, at least one socket connector configured for coupling with a power source, and a housing comprising at least one light-penetrable surface, the lamp being operatively connected to the socket connector and the socket connector connected to the housing such that the lamp is disposed within the housing, said hue-modifying wrap comprising:

at least one hue-modifying portion, the hue-modifying portion being generally light-penetrable and shaped for operative transition between a first, expanded configuration and second, contracted configuration to at least a portion of the light-penetrable surface;

wherein the hue-modifying wrap is affixed to at least a portion of the light-penetrable surface as a result of the hue-modifying portion transitioning between the expanded configuration and contracted configuration, the hue-modifying portion further altering the hue of light emitted from the light bulb, and wherein the hue-modifying wrap comprises an adhesive side and a non-adhesive side, the adhesive side for application to at least a portion of the light-penetrable surface, the hue-modifying wrap further comprising a first end and second end, the first end being opposite the second end, the first end defining a plurality of projections, the projections for operative transition between a first, expanded configuration and second, contracted configuration to at least a portion of the light-penetrable surface.

22. A hue-modifying wrap for a light bulb, the light bulb comprising at least one lamp, at least one socket connector configured for coupling with a power source, and a housing comprising at least one light-penetrable surface, the lamp being operatively connected to the socket connector and the socket connector connected to the housing such that the lamp is disposed within the housing, said hue-modifying wrap comprising:

at least one hue-modifying portion, the hue-modifying portion being generally light-penetrable and shaped for operative transition between a first, expanded configuration and second, contracted configuration to at least a portion of the light-penetrable surface;

wherein the hue-modifying wrap is affixed to at least a portion of the light-penetrable surface as a result of the hue-modifying portion transitioning between the expanded configuration and contracted configuration, the hue-modifying portion further altering the hue of light emitted from the light bulb, and wherein the hue-modifying wrap comprises indicia printed thereon, the hue-modifying wrap further comprising a first end and second end, the first end being opposite the second end, the first end defining a plurality of projections, the projections for operative transition between a first, expanded configuration and second, contracted configuration to at least a portion of the light-penetrable surface.

23. A hue-modifying wrap for a light bulb, the light bulb comprising at least one lamp, at least one socket connector configured for coupling with a power source, and a housing comprising at least one light-penetrable surface, the lamp being operatively connected to the socket connector and the socket connector connected to the housing such that the lamp is disposed within the housing, said hue-modifying wrap comprising:

at least one hue-modifying portion, the hue-modifying portion being generally light-penetrable and shaped for operative transition between a first, expanded configuration and second, contracted configuration to at least a portion of the light-penetrable surface;

wherein the hue-modifying wrap is affixed to at least a portion of the light-penetrable surface as a result of the hue-modifying portion transitioning between the expanded configuration and contracted configuration, the hue-modifying portion further altering the hue of light emitted from the light bulb, wherein the hue-modifying wrap comprises indicia printed thereon, the hue-modifying wrap further comprising an adhesive side and a non-adhesive side, the adhesive side for application to at least a portion of the light-penetrable surface, the hue-modifying wrap further comprising a first end and second end, the first end being opposite the second end, the first end defining a plurality of projections, the projections for operative transition between a first, expanded configuration and second, contracted configuration to at least a portion of the light-penetrable surface.

24. A hue-modifying wrap for a light bulb, the light bulb comprising at least one lamp, at least one socket connector configured for coupling with a power source, and a housing comprising at least one light-penetrable surface, the lamp being operatively connected to the socket connector and the socket connector connected to the housing such that the lamp is disposed within the housing, said hue-modifying wrap comprising:

at least one hue-modifying portion, the hue-modifying portion being generally light-penetrable and shaped for operative transition between a first, expanded configuration and second, contracted configuration to at least a portion of the light-penetrable surface;

wherein the hue-modifying wrap is affixed to at least a portion of the light-penetrable surface as a result of the hue-modifying portion transitioning between the expanded configuration and contracted configuration, the hue-modifying portion further altering the hue of light emitted from the light bulb, and wherein the hue-modifying wrap comprises indicia printed thereon, the hue-modifying wrap further comprising an adhesive side and a non-adhesive side, the adhesive side for application to at least a portion of the light-penetrable surface, the adhesive side further comprising an adhesive, the hue-modifying wrap further comprising a first end and second end, the first end being opposite the second end, the first end defining a plurality of projections, the projections for operative transition between a first, expanded configuration and second, contracted configuration to at least a portion of the light-penetrable surface.

* * * * *